US009353464B2

(12) United States Patent
Schneider et al.

(10) Patent No.: US 9,353,464 B2
(45) Date of Patent: May 31, 2016

(54) SPINNING MACHINE HAVING A COMPACTION DEVICE

(75) Inventors: Gabriel Schneider, Winterthur (CH); Ludek Malina, Kloten (CH); Robert Nägeli, Kleinandelfingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 182 days.

(21) Appl. No.: 14/234,782

(22) PCT Filed: Jun. 29, 2012

(86) PCT No.: PCT/CH2012/000144

§ 371 (c)(1),
(2), (4) Date: Jan. 24, 2014

(87) PCT Pub. No.: WO2013/013330

PCT Pub. Date: Jan. 31, 2013

(65) Prior Publication Data

US 2014/0157749 A1 Jun. 12, 2014

(30) Foreign Application Priority Data

Jul. 25, 2011 (CH) ..... 1241/11

(51) Int. Cl.
*D01H 5/86* (2006.01)
*D01H 5/72* (2006.01)
(Continued)

(52) U.S. Cl.
CPC ..... *D01H 5/86* (2013.01); *D01H 1/025* (2013.01); *D01H 5/72* (2013.01); *D01H 5/74* (2013.01)

(58) Field of Classification Search
CPC ..... D01H 1/025; D01H 5/50; D01H 5/505; D01H 5/56; D01H 5/72; D01H 5/74; D01H 5/86
USPC ..... 57/315
See application file for complete search history.

(56) References Cited

U.S. PATENT DOCUMENTS 5,600,872 A * 2/1997 Artzt ..... D01H 1/025 19/150
6,032,451 A * 3/2000 Dinkelmann ..... D01H 1/025 57/315

(Continued)

FOREIGN PATENT DOCUMENTS

CN 2851298 12/2006
CN 101513896 12/2009

(Continued)

OTHER PUBLICATIONS

PCT Search Report, Oct. 11, 2012.

*Primary Examiner* — Shaun R Hurley
(74) *Attorney, Agent, or Firm* — Dority & Manning, P.A.

(57) ABSTRACT

A device for compacting a fiber composite on a spinning machine includes consecutive drafting arrangement roller pairs. A compaction unit is pivotably mounted on the machine frame downstream of the delivery roller pairs with a pivot axis parallel to the rotational axes of the delivery roller pair, and includes a support with a suction drum rotatably supported on the support. At the end of a suction zone of the drum, a nip roller is fastened to the support to form a nip line. The support is spring-loaded to form a drive connection between the lower roller of the delivery roller pair and the suction drum, wherein the suction drum is moved against the lower roller. Guide means fix the compaction unit in position as mounted on the machine frame, and the spring element is mounted on the free end of the pressure lever.

13 Claims, 3 Drawing Sheets

(51) Int. Cl.
*D01H 1/02* (2006.01)
*D01H 5/74* (2006.01)

(56) References Cited

U.S. PATENT DOCUMENTS 6,131,382 A * 10/2000 Dinkelmann ..... D01H 1/025 57/315
6,131,383 A * 10/2000 Dinkelmann ..... D01H 1/025 57/315
6,324,825 B2 * 12/2001 Dinkelmann ..... D01H 1/025 19/150
2001/0020357 A1 * 9/2001 Dinkelmann ..... D01H 1/025 57/315
2012/0297748 A1 * 11/2012 Malina ..... D01H 5/82 57/315
2013/0239369 A1 9/2013 Schneider et al.
2015/0027098 A1 * 1/2015 Nageli ..... D01H 5/72 57/315

FOREIGN PATENT DOCUMENTS

DE 197 08 410 A1 9/1998
DE 199 33 747 A1 1/2001
DE 102 27 463 C1 10/2003
EP 1 300 495 A1 4/2003
EP 2 333 137 A1 6/2011

* cited by examiner

SPINNING MACHINE HAVING A COMPACTION DEVICE

FIELD OF THE INVENTION

The invention relates to a device compacting a fiber composite on a spinning machine with a drafting arrangement unit including consecutively arranged drafting arrangement roller pairs having pressure rollers that are held in place on a pressure lever, which is pivotably supported on the machine frame, and with a pivotably mounted compaction unit downstream of the delivery roller pair of the drafting arrangement unit on the machine frame.

A multitude of configurations is known in the art from practical applications, wherein a compacting means is disposed downstream of a drafting arrangement unit for the purpose of compacting the fiber material (fiber strand) that is discharged by the drafting arrangement. Downstream of such a compacting means, and after traversing a nip, the compacted fiber material is fed to a device that generates a twist. On a ring spinning machine, a twist-generating means of this kind includes, for example, a traveller that rotates on a ring, and wherein the produced yarn is wound onto a rotating tube. Rotating, perforated drums that have suction applied to them or rotating small aprons that are provided with perforations are conceivable for use as compacting means Compacting devices that can be installed as a retrofitting measure on existing drafting arrangements units are known in art. For example, CN 101613896 A discloses such a device, wherein an additional element is screwed to the punch in order to extend the punch in terms of length. At the same time, this embodiment shows a gear step with gear pairs that are provided to power an additional compaction device.

Moreover, CN 2851298 Y discloses an embodiment, wherein the compaction roller is fastened to the frame element together with the twist stop roller operating in conjunction with the same, and wherein the nip roller of the delivery roller pair of the drafting arrangement unit is supported thereon as well. The frame element is connected to the frame of the machine or the drafting arrangement unit, respectively, by means of screwed connections. In the shown device, the nip roller of the delivery roller pair take off the drive power of the suction drum directly, via friction. This is the reason why this system can be retrofitted to match existing drafting arrangement units of a spinning machine. However, the amount of time that must be calculated for returning the spinning machine to a drafting arrangement unit wing frame without compacting is considerable. For spinning machines running with over 1000 spinning positions, this can be an enormous undertaking. Handling periodic maintenance tasks also involves a substantial time expenditure, if the compaction device must be disassembled each time.

Therefore, the Swiss patent application CH 01992/10 of Nov. 26, 2010, proposes a retrofit-ready compaction assembly that is a compact structural unit and can be easily pivotably mounted on the spinning machine. Due to the proposed pivotable installation, the device is easily transferred from the mounted position thereof into an operating position at the exit of the drawing system unit. In the same manner, it can be just as easily and quickly, and without any need for tools, moved into a non-operating position. The shown compaction roller is powered by means of friction and special drive means by the driven lower roller of the delivery roller pair of the drafting arrangement unit. In this, the compaction roller is pressed against the lower roller of the delivery roller pair by means of specially provided compressive-force elements on the machine frame. Special installation of such compressive-force elements is complex; in addition, the compressive-force elements must be precisely adjusted to accommodate the compaction roller to which the load must be applied. In the context of the known solutions, any transfer of the nip rollers of the drafting arrangement unit and transfer of the compaction unit into the operating (working) position thereof must be done independently and separately. Moreover, this solution does not allow for a direct, matched positioning of the pivotable pressure lever of the nip rollers of the drafting arrangement unit in conjunction with the pivotable structural compaction component, which can be disadvantageous, for example, if the individual rollers are not exactly aligned with each other.

SUMMARY OF THE INVENTION

Therefore, based on the known prior art, it is the object of the present invention to remedy the disadvantages of known solutions and to improve available solutions. Additional objects and advantages of the invention will be set forth in part in the following description, or may be obvious from the description, or may be learned through practice of the invention.

This is why it is presently proposed to provide guide means in the area of the pivot axis of the support of the compaction unit by which the compaction unit is fixed in place on the machine frame, seen in the direction of the pivot axis, and the spring element, which is applied to the support during the transfer into the operating position, is disposed on the free end of the pressure lever (also referred to as "load arm").

Using the presently proposed device, upon actuation of only a single pressure lever, it is possible to move both systems (the pressure rollers of the drafting arrangement unit and the compaction unit) into their operating position and fix them in place in that position. The result is easy and quick operability. Due to the single or multiple spring elements, the compaction unit is held in the operating position into which it was pivoted and in which it constitutes, together with the lower rollers of the delivery roller pair, a drive connection (for example, by means of friction). Moreover, via the spring element that is mounted to the pressure lever, the drafting arrangement unit is directly coupled to the compaction unit, when said drafting arrangement unit is in the operating position, wherein the result in a closed unit that is also less susceptible to vibrations.

The proposed guide means hold the compaction unit in a defined position (seen in the direction of the pivot axis) on the machine frame of the spinning machine. The term "spring element" also includes embodiments (and/or combinations of elements) where a rigid means (for example, a rod or a lever) is spring-loaded; meaning, the term "spring element" also includes the term "spring-loaded retaining element".

Furthermore, it is proposed to provide the support with a coupling point that forms, when in the operating position, a positive connection with the spring element by which the pressure lever, seen diagonally relative to the pivot plane thereof, is fixed in place in relation to the support. This way, a completely interlocked and closed system is achieved, wherein all roller pairs, seen in the axial direction thereof, are non-displaceably and exactly aligned in relation to each other; meaning, both pivotable elements "pressure lever with compression rollers" and "compaction unit" are exactly aligned and fixed in place in relation to each other.

The coupling point on the support can, depending on the configuration of the spring element that is fastened to the pressure lever, include elevations and depressions. The essential aspect is that a positive closure connection is obtained by which both elements (the support of the compaction unit and the spring element of the pressure lever) can be non-displaceably positioned in relation to each other.

Further, it is proposed that the spring element be constituted of a retainer that is pivotably mounted on the pressure lever, and which is spring-loaded. This way, utilizing the retainer that is fastened to the pressure lever in a spring-loaded fashion, it is possible to simultaneously transfer the contact force, which is necessary for powering the suction drum, to the structural component of the compaction unit; meaning, due to the contact force, a sufficient amount of frictional force is generated to accommodate the power transfer between the drive elements of the suction drum and the lower roller of the delivery roller pair of the drafting arrangement unit.

Instead of a spring-loaded retainer, it is also possible to envision the spring element as a leaf spring that is directly fastened to the pressure lever. The result is a simplified structural assembly that has the same effect.

Furthermore, it is proposed to provide the support with a suction channel having one end that opens in the area of the pivot point of the support and one end that opens in the area of a suction insert that extends into the compaction element. The result is a compact unit, which also has the suction channel integrated therein and which can be locked, via the coupling point, as a total unit with the pressure lever; meaning, the compaction unit complete with integrated suction channel constitutes a compact and closed structural unit that can be quickly and easily assembled and/or disassembled, as required.

Further, it is proposed that the support be provided with a U-shaped end piece by which, when in the mounted position, the same partially grasps around a circular channel at the location of a coupling point, and the channel is fastened to the machine frame and connected to a negative pressure source. This ensures a problem-free and easy hook-up of the compaction unit to the machine frame in a first non-operating position, prior to the unit being transferred and fixed in the operating position by means of the pressure lever and the lever that is fastened thereto. However, other solutions for fastening the compaction unit and/or the support thereof via a pivot axis to the machine frame are conceivable.

To securely fix the compaction unit (structural unit) in the axial direction of the suction drum and/or transversely relative to the direction of flow of the fiber material, it is proposed to provide guide means in the area of the coupling point in order to achieve a lateral fixation of the U-shaped end piece. It is possible therein to provide lateral guide means for the support on the channel, to fix the support in the position thereof. It is also possible to provide depressions in the circular channel into which the support reaches, and whereby the support is laterally guided.

It is further proposed that the pinch roller (also referred to as "twist-stop") is disposed, with the ability to rotate freely, on a compressive arm that is pivotably mounted on the support. For a compact and closed configuration, it is advantageous therein to provide a spring element between the pivot axis of the compressive arm and the axis of rotation of the roller. On grounds of fibre fly in a spinning mill, a closed design of moving elements (for example, spring elements) is advantageous to avoid soiling of these parts.

To achieve a dead-center position for the transfer of the roller from a non-operating position to an operating position, it is presently proposed for the pivot axis of the compressive arm to be located above the plane that extends through the pivot axis of the support and the axis of rotation of the suction drum.

During the transfer process of the support from a non-operating position to an operating position, it is possible therein to transfer the axis of rotation of the roller from a first position above the connecting line between the pivot axis of the compressive arm and the axis of rotation of the compaction element into a second position below this connecting line, while overcoming a dead-center position.

To hold the compressive arm of the pinch roller in the above-dead-center position, it is proposed to provide a stop on the support that projects into the motion range of the compressive arm to retain said compressive arm in said second position.

To transfer the support of the compaction unit in an easy manner into the first non-operating position thereof on the machine frame, it is proposed to provide guide means on the machine frame by which the support is guided to the coupling point in the context of a transfer into a first non-operating pivot position.

The structural unit of the compaction unit typically extends over two drafting arrangement units (twin drafting arrangement), wherein two suction drums are mounted on one support of the structural unit. Therefore, it is proposed that the drafting arrangement unit is a twin drafting unit with two drafting arrangements that are disposed next to each other, and the compression rollers of the drafting arrangements are held by one common pressure lever, and the suction drums with nip roller that are each allocated to the respective delivery roller pair are supported on a common support with the ability to rotate freely.

BRIEF DESCRIPTION OF THE DRAWINGS

Further advantages of the invention will be described and illustrated in further detail in the embodiments below.

Shown are as follows.

DETAILED DESCRIPTION

Figure 1:
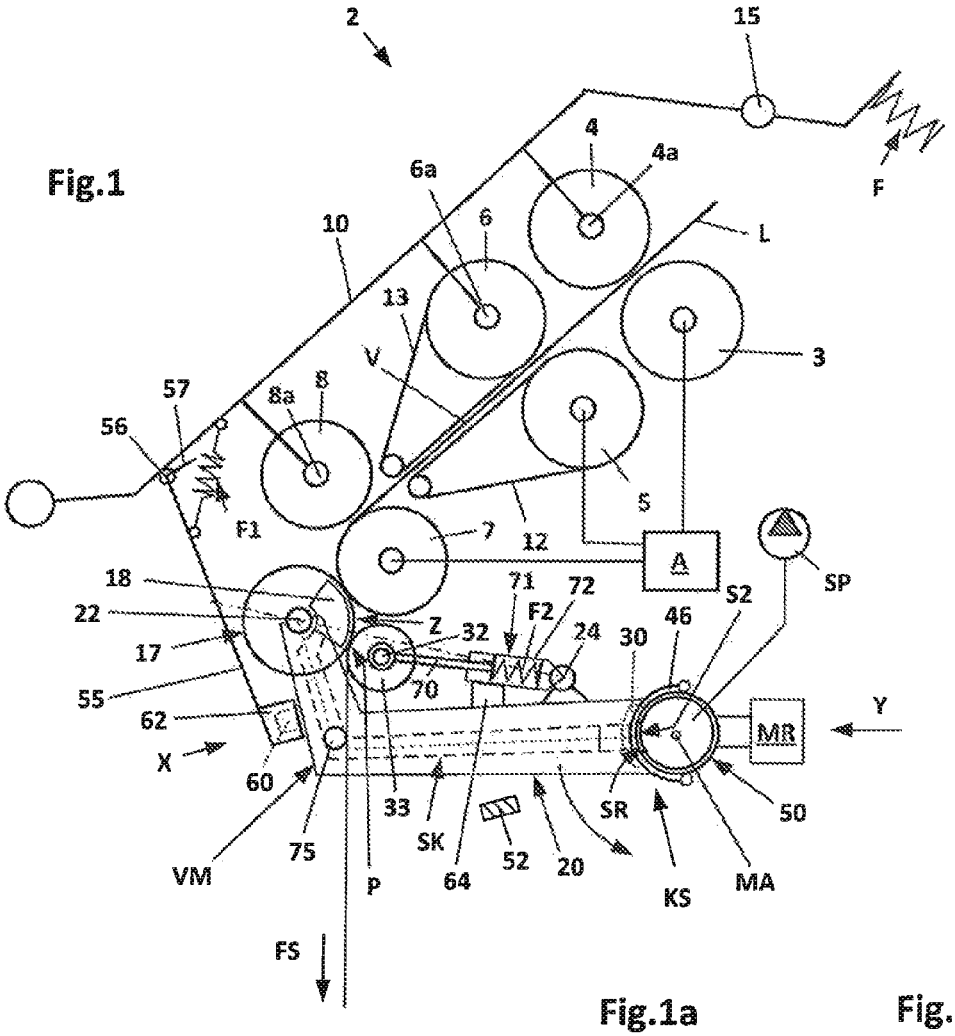
FIG. 1 is a representation of a schematic side view of a drafting arrangement unit with an attached structural unit of a compaction unit that is in the locked position.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a spinning station 1 of a spinning machine (ring spinning machine) with a drafting arrangement unit 2 that is provided with an entry roller pair 3, 4, a center roller pair 5, 6 and a delivery roller pair 7, 8. One small apron 12, 13 is guided, respectively, around the center rollers 5, 6 that are held in place by a cage, presently not shown in further detail. The upper rollers 4, 6, 8 of the mentioned roller pairs are designed as pressure rollers that are supported, with the ability to rotate freely and via the axes 4*a*, 6*a*, 8*a*, on a pivotably supported pressure lever 10. The pressure lever 10 is pivotably supported about an axis 15 and spring-loaded by a spring element F, as presently schematically depicted. This spring element can also be an air hose, for example. The spring load, as depicted schematically, presses the rollers 4, 6, 8 against the lower rollers 3, 5 and 7 of the roller pairs, whereby a nip is created for the fibrous material. The roller pairs 3, 5, 7 are connected to a drive means A, as indicated schematically. Individual drives can be used therein, as well as other types of drive means (gears, toothed belts, etc.). The pressure rollers 4, 6, 8 are frictionally powered by the driven bottom rollers 3, 5, 7, and/or the small apron 13 by the small apron 12. The circumferential speed of the driven roller 5 is somewhat higher than the circumferential speed of the driven roller 3, whereby the fibrous material, that is supplied as a roving L and supplied to the drafting arrangement unit 2, undergoes a preliminary draft effect between the entry roller pair and the center roller pair 5, 6. The main draft of the fiber material V occurs between the center roller pair 5, 6 and the delivery roller pair 7, 8, wherein the delivery roller 7 has a circumferential speed that is substantially greater than the center roller 5.

Figure 5:
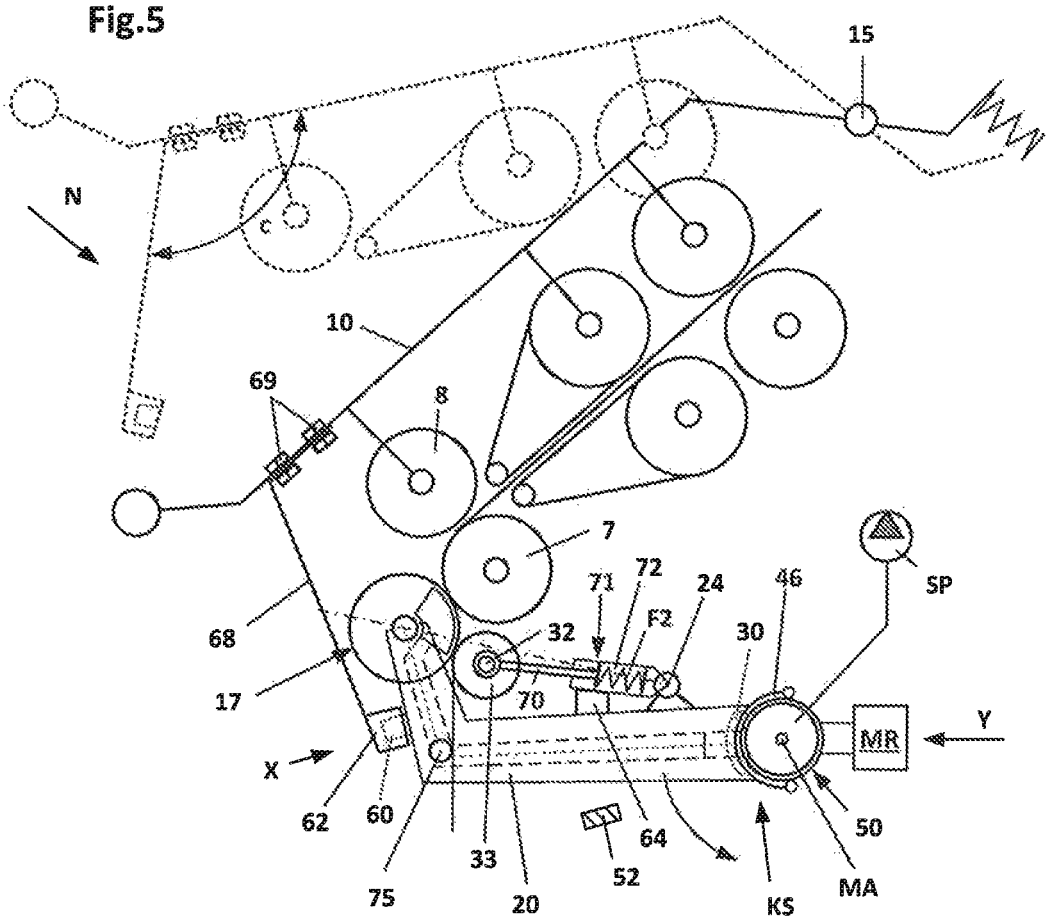
FIG. 5 is a representation of a further embodiment of the invention according to FIG. 1.
Figure 5A:
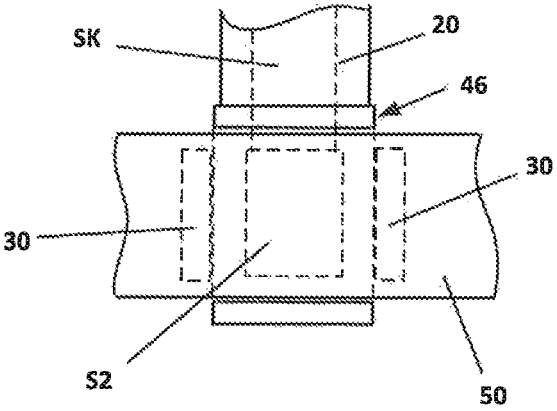
FIG. 5*a* is a representation of an enlargement of region Y according to FIG. 5 with lateral guide means for the lateral fixation of the support of the compaction unit.
Figure 5B:
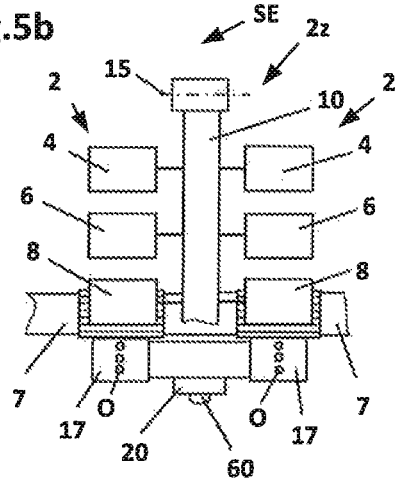
FIG. 5*b* is a representation of a miniaturized top view of region N according to FIG. 5.

As can be seen in FIG. 5*b* (perspective N according to FIG. 5), one pressure lever 10 is allocated to two neighboring drafting arrangement units 2 (twin drafting arrangement). Since these are identical elements of neighboring drafting arrangement units and/or compaction units and/or elements that are disposed as partially mirroring each other, identical reference symbols are used below for these same parts.

Figure 1A:
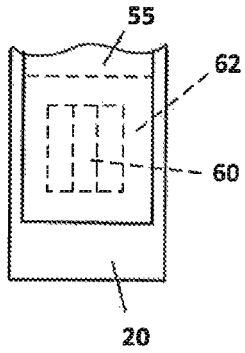
FIG. 1*a* is a representation of an enlargement of region X of the coupling point according to FIG. 1.
Figure 1B:
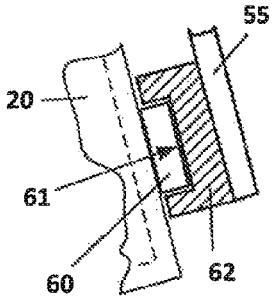
FIG. 1*b* is a representation of a side view according to FIG. 1*a;*
Figure 1B:
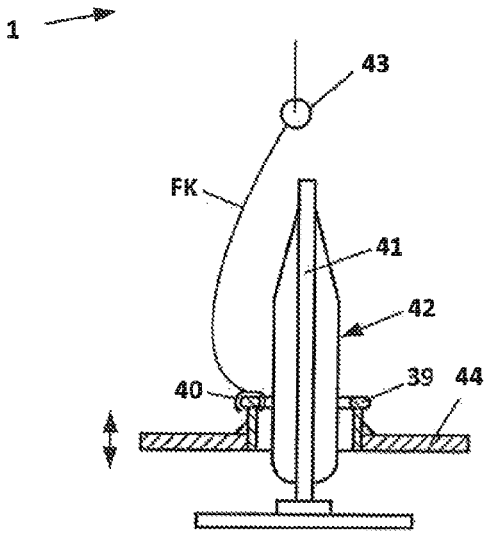

Referring again to FIG. 1, the drawn fiber material V that is issued by the delivery roller pair 7, 8 is deflected downward and reaches the area of suction zone Z of a (downstream) suction drum 17. The respective suction drum 17 is provided with perforations and/or openings O that extend along the circumference of said suction drum. One stationary suction insert 18 is disposed in the rotatably disposed suction drum 17 that is mounted on a support 20 of a compaction unit VM. Designs and arrangements of the suction insert are described in the Swiss patent application CH 01992/10 of Nov. 26, 2010. Also shown therein are drive elements that are connected to the respective suction drum 17 and that enter into a frictional-contact connection with the lower roller 7 of the delivery roller pair, when they are in the operating position. At any rate, the respective suction roller 17, or drive means that is connected thereto, rests on the circumference of the driven roller 7 and is driven by the same via friction. The contact pressure force of the suction roller 17 on the lower roller 7 is achieved in the embodiment as shown in FIG. 1 via a lever 55 that is mounted to the pressure lever 10, having the ability to pivot about an axis 56. The lever 55 is provided with an extension 57 that runs from the pivot axis 56 along the pressure lever 10. A spring F1 is mounted on the pressure lever 10 at a distance relative to the pivot axis 56, which is also fastened to the lever 55 by the other end thereof, also at a distance relative to the pivot axis 56. The spring F1 causes the lever 55 to pivot counterclockwise in relation to the pivot axis 56. In the operating position, as shown in FIG. 1, where the pressure lever 10 is closed, the pivoting motion that is caused by the spring F1 is restricted by an attachment 60, which is fastened to the support 20 of the compaction unit VM. As can be derived from the enlarged views in FIG. 1*a* (perspective X according to FIG. 1) to FIG. 1*b*, a bar 62 that is mounted on the free end of the lever 55 forms a positive closure connection with the attachment 60 via the depression 61 disposed therein. This way, the pressure lever 10 and the pressure rollers 4, 6, 8, which are mounted on the pressure lever, are fixedly coupled to the support 20 of the compaction unit VM, whereby the lateral positioning of these compression rollers relative to the suction roller 17 and the pinch roller 33 thereof is achieved; meaning, the pressure lever 10 is indirectly fixed in place, via the compaction unit VM and transversely relative to the pivot plane SE (FIG. 5*b*) thereof, also in relation to the machine frame MR.

Moreover, this simultaneous locking action of the drafting arrangement unit 2 and the compaction unit VM by means of only one pressure lever 10, ensures that, in the locked operating position of the pressure lever, the suction drums of the compaction unit are also in the operating position. In earlier solutions that involved independent locks, this was not always guaranteed; meaning, if the operator forgot, prior to the start of the spinning machine, to transfer the compaction unit VM in the operating position thereof as well, material back-ups between the drawing system unit 2 and the compaction unit VM downstream could be the consequence, resulting in interruptions of the spinning process at the corresponding spinning position. This problem is avoided by the proposed common locking action according to the invention of the drafting arrangement unit 2 and the compaction unit VM by means of the pressure lever 10; meaning, fiber material is only delivered to the compaction unit if the drafting arrangement unit is closed as well.

The suction roller 17 and/or the two suction rollers 17 (FIGS. 5*a* and 5*b*) that are allocated to the twin drafting arrangement 22 is/are rotably supported on a support 20 of the compaction unit VM on an axis 22 that is mounted on the support 20. A suction channel SK is provided inside the support 20 that is in communication with the respective suction insert 18, as shown schematically in FIG. 1. On an end of the support 20 that is directed toward the machine frame MR of the spinning machine, the support is provided with a U-shaped end piece 46, and the suction channel SK opens into the same by the opening S2. In the shown position, the opening S2 is disposed opposite an opening SR of a suction pipe 50 that is mounted on the machine frame MR of the spinning machine. By the U-shaped end piece 46, that is mounted on the end of the support 20, the support 20 is pivotably mounted about the center axis MA of the suction pipe, and it thereby constitutes a coupling point KS. A nip effect between the suction pipe 50 and the end piece 46 is achieved by an end piece that is configured with corresponding dimensions in relation to the dimension of the suction pipe 50, and whereby the support 20 is retained on the suction pipe 50.

As indicated schematically in FIG. 1, the guide means 30 are mounted on both sides of the end piece 46 on the suction pipe 50 by which the end piece 46, and thereby the compaction unit VM, are laterally fixed in the direction of the center axis MA. This can be derived from the enlarged representation as seen in FIG. 5*a* (perspective Y according to FIG. 5). By this lateral fixation of the compaction unit on the suction pipe 50, and therefore on the machine frame MR, the pressure lever 10 with the compression rollers 4, 6, 8 is also held in a fixed position relative to the machine frame via the coupling point 55, 60, 62.

Under the effect of a negative pressure that is applied in a suction zone Z via the negative pressure source SP, the outwardly extending fibers are incorporated, and the fiber material is compressed. To this end, the respective suction drum is provided with openings O along the circumference thereof that interact with the suction slots of the suction insert 18, presently not shown.

A nip roller 33 is provided downstream of the suction zone Z for each of the suction drums 17, and that is held inside a compressive arm 71 and rests on the respective suction drum 17 via a pressure load forming a nip line P with the suction drum. The respective nip roller 33 therein is rotatably supported on an axis 32 that is mounted to a piston 70 of a compressive arm 71. The piston 70 extends into a cylinder 72 and inside which it is displaceably guided in a longitudinal direction and spring-loaded by the compression spring F2. This load application causes the nip roller 33 to be pushed in the direction of a suction roller. The cylinder 72 is pivotably mounted on an axis 24 that is connected to the support 20. Therefore, in the present embodiment, the compressive arm 71 consists of a cylinder 72 with a pivot axis 24 and a spring-loaded piston 70 that has a load applied thereto by a spring F2.

The nip line P constitutes, simultaneously, a so-called "twin-stop gap" from where the fiber material is supplied in the transport direction FS, and in form of a compacted yarn FK with twist insertion, to a ring spinning frame, which is shown in a schematic depiction. The ring spinning frame is provided with an ring 39 and a traveller 40, wherein the yarn is wound up on a tube 41 to form a bobbin 42 (cop). A thread guide 43 is disposed between the nip line P and the traveller 40. The ring 39 is mounted on a ring frame 44 that executes an up-and-down motion during the spinning process.

To continue to be able to suck-off the yarn FK that is still being delivered via the nip point P, even in the event of a yarn rupture between the nip line P and the bobbin 42, a suction pipe 75 is mounted respectively on both sides of the support 20, which is provided with an opening, presently not shown. The suction pipe opens into the suction channel SK of the support 20.

Figure 2:
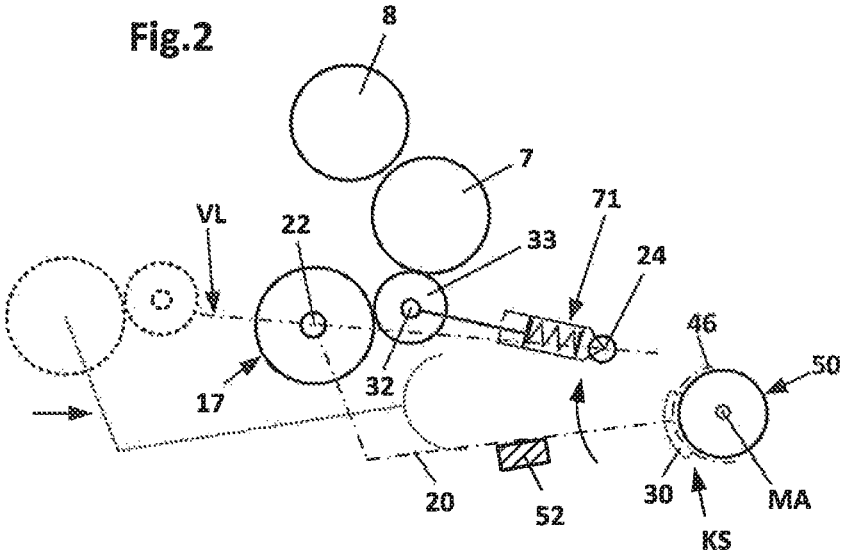
FIG. 2 is a representation of a schematic partial view of the compaction unit seen in a non-operating position with a nip roller above the dead-center position.
Figure 3:
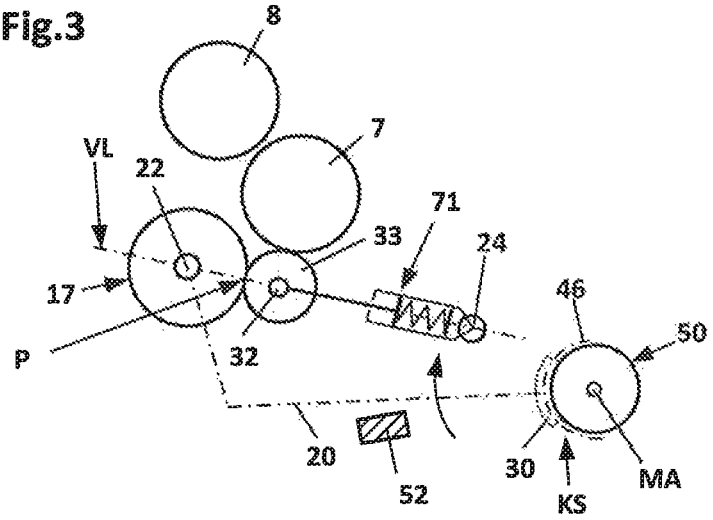
FIG. 3 is a representation of a schematic partial view according to FIG. 2 with a roller in the dead-center position.
Figure 4:
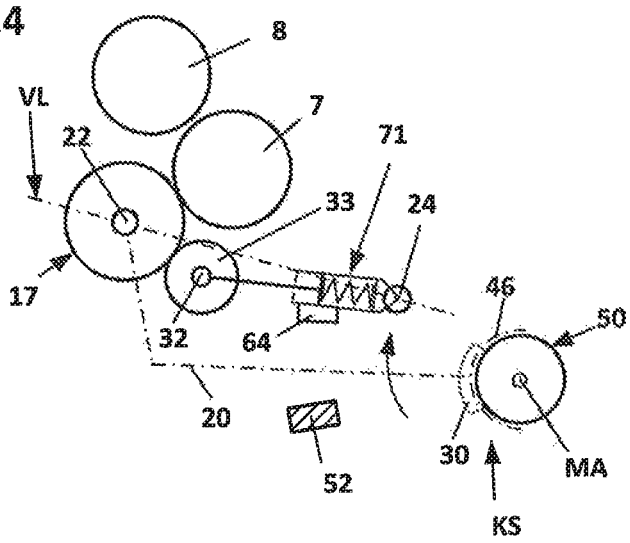
FIG. 4 is a representation of a schematic partial view according to FIG. 2 with a roller below the dead-center position.

The transfer of the suction drums 17 from a non-operating position into an operating position is depicted in the embodiments as shown in FIG. 2 to FIG. 4. The support 20 is only schematically indicated by a perforated line.

As can be seen from FIG. 2, the support 20 is transferred by means of the guide 52 (that constitutes, simultaneously, a stop for the lower pivot position of the compaction unit VM) from a position that is shown by a perforated line to a mounted first non-operating position. In this, while displacing the support in the direction of the suction pipe 50, the end piece 46 is pushed onto the suction pipe 50 by hand in the area of the coupling point KS until it is seated on the suction pipe and clamped thereon. The end piece 46 is pushed on between the lateral guides 30. Via the end piece 46, the support 20 and/or the total compaction unit VM can now be pivoted about the center axis MA of the suction pipe 50 in the direction of the delivery roller pair 7, 8 of the drafting arrangement unit 2.

As seen in FIG. 2, during a pivoting action (see direction of arrow), the nip roller 33 comes to rest on the lower roller 7 of the delivery roller pair 7, 8 of the drafting arrangement unit 2. With further pivoting action, the nip roller 33 reaches the dead-center position, as depicted in FIG. 3, where the axis of rotation 32 comes to lie precisely on the connecting line VL between the axis 22 of the suction drum 17 and the pivot axis 24 of the cylinder 72. Due to the spring F2, that is disposed inside the cylinder 72, the nip roller 33 is always maintained as staying in contact against the outer circumference of the suction drum 17. With further manual pivoting of the compaction unit VM in the direction of the arrow, a position is reached that is schematically depicted in FIG. 4. Here, the suction roller 17 or drive means connected with it come(s) into contact with the lower roller 7, wherein, by means of a frictional closure (friction), a drive connection is created between the driven roller 7 and the suction roller 17. Simultaneously, under the effect of the lower roller 7 and the spring F2, the nip roller 33 is pivoted to a position beyond dead center, as shown in FIG. 4; meaning, the axis 32 of the nip roller 33 is now below the connecting line VL between the axis 22 of the suction drum 17 and the pivot axis 24 of the cylinder 72. To restrict the pivot motion of the cylinder 72, and thereby of the nip roller 33, in the downward direction, a stop 64 is affixed to the support 20 on which the cylinder 72 comes to rest (FIG. 4). In the operating position as shown in FIG. 4, under the effect of the spring F2, the nip roller 33 forms a nip point P together with the suction drum 17, and it is driven via friction by means of the suction drum. After reaching the operating position as shown in FIG. 4 (as described previously), the pressure lever 10 is closed, wherein, using the bar 62 that is mounted on the lever 55 and the attachment 60 that is provided on the support 20, the compaction unit UM is locked along with the drafting arrangement unit 2.

The disassembly of the compaction unit is achieved in the reverse order. Following disassembly, the nip roller 33 can also be returned manually into the position as shown in FIG. 2.

The embodiment as shown in FIG. 5 corresponds essentially to the embodiment as depicted in FIG. 1. The only difference that can be found lies in the locking element that is mounted on the pressure lever 10. Instead of a lever 55, a leaf spring 68 is used in this embodiment, which is mounted on the pressure lever 10 by means of the screws 69. The angle c that is present when the leaf spring 68 is swung in the upward position, which is indicated by the perforated line, is enlarged, when the closed operating position is in effect, which is indicated by the solid line. Correspondingly, in the area of the bar 62 that is mounted at the end thereof, the leaf spring exercises a compressive force in the direction of the attachment 60 that is mounted on the support 20 and by which the compaction unit is locked in this position.

Mounting the attachment 60 directly in the area of the bearing for the axis 22 is possible as well. A plurality of other embodied variants is conceivable in the context of implementing the locking means.

Therefore, the proposed invention provides easy operability in connection with the assembly and disassembly of the compaction unit. Moreover, with the proposed locking means, the positions of the rollers of the drafting arrangement unit and of the compaction unit are exactly fixed in relation to the machine frame for the entire duration of the operation. This way, constant conditions are ensured throughout the entire duration of operation.

The invention claimed is:

1. A spinning machine, comprising:

a machine frame;

a drafting unit with consecutively arranged drafting roller pairs having a respective pressure roller held on a pressure lever that is pivotably mounted on the machine frame, the drafting rollers including a delivery roller pair;

a compaction unit pivotably mounted on the machine frame downstream of the delivery roller pair, the compaction unit including a support having a pivot axis that extends parallel to axes of rotation of the delivery roller pair;

a suction drum rotatably supported on the support, the suction drum defining a suction zone;

a nip roller mounted on the support and biased against the suction drum with a compressive element, the nip roller defining a nip line with the suction drum at an end of the suction zone;

a spring element disposed so as to apply a compressive force to the support such that the suction drum is moved against and forms a drive connection with a lower roller of the delivery roller pair;

the spring element mounted at a free end of the pressure lever; and guide elements disposed adjacent the pivot axis of support and fixing the compaction unit in position relative to the machine frame.

2. The spinning machine as in claim 1, wherein the support comprises a first coupling point that forms a positive connection with a second coupling point of the spring element in an operating position of the compaction unit, the coupling points fixing the pressure lever in position relative to the support seen transversely relative to a pivot plane of the pressure lever.

3. The spinning machine as in claim 1, wherein the spring element comprises a lever that is pivotably mounted on the pressure lever, and a spring disposed to apply a compressive force to the lever.

4. The spinning machine as in claim 1, wherein the spring element comprises a leaf spring.

5. The spinning machine as in claim 1, wherein the support comprises a suction channel having one end that opens adjacent the pivot axis of the support and an opposite end that opens at a suction insert that extends into the suction drum.

6. The spinning machine as in claim 5, wherein the support comprises a U-shaped end piece that fits around a circular channel at a coupling point with the machine frame, the circular channel fastened to the machine frame and connected to a negative pressure source.

7. The spinning machine as in claim 6, wherein the guide elements laterally fix the U-shaped end piece at the coupling point.

8. The spinning machine as in claim 1, wherein the nip roller is disposed on a compressive arm that is pivotably mounted on the support.

9. The spinning machine as in claim 8, wherein the compressive element is disposed between a pivot axis of the compressive arm and an axis of rotation of the nip roller.

10. The spinning machine as in claim 9, wherein the pivot axis of the compressive arm is disposed above a plane that extends through the pivot axis of the support and the axis of rotation of the suction drum.

11. The spinning machine as in claim 10, further comprising a stop provided on the support that engages against the compressive arm and holds the compressive arm in position relative to the suction drum.

12. The spinning machine as in claim 1, further comprising a guide member on the machine frame that engages the support in a non-operational pivoted position of the support relative to the machine frame.

13. The spinning machine as in claim 1, wherein the drafting unit is a twin drawing system comprising two drafting arrangements disposed adjacent each other, each drafting arrangement comprising consecutively arranged drafting roller pairs having a respective pressure roller held on the pressure lever that is common to both drafting arrangements, and further comprising a respective suction drum and nip roller for each drafting arrangement, the suction drums and nip rollers supported on a common support of the compaction unit.

* * * * *